US007455561B1

(12) United States Patent
Tuttle

(10) Patent No.: US 7,455,561 B1
(45) Date of Patent: Nov. 25, 2008

(54) SINKABLE BUOY SYSTEM FOR USE WITH A WATER SPORTS COURSE

(75) Inventor: Walter L. Tuttle, Sherrills Ford, NC (US)

(73) Assignee: Wallyskier, Inc., Sherrills Ford, NC (US)

( * ) Notice: Subject to any disclaimer, the term of this patent is extended or adjusted under 35 U.S.C. 154(b) by 0 days.

(21) Appl. No.: 11/403,718

(22) Filed: Apr. 13, 2006

(51) Int. Cl.
*B63B 22/16* (2006.01)

(52) U.S. Cl. ..... 441/6; 441/23; 441/29

(58) Field of Classification Search ..... 441/1, 441/2, 6, 11–21, 23–29, 30
See application file for complete search history.

(56) References Cited

U.S. PATENT DOCUMENTS 2,534,716 A * 12/1950 Hudspeth et al. ..... 441/20
3,878,576 A * 4/1975 Suyderhoud ..... 441/6
3,936,895 A * 2/1976 Talkington ..... 441/21
4,189,786 A * 2/1980 Adler ..... 367/4
5,503,188 A * 4/1996 Petrone ..... 138/93
5,516,317 A * 5/1996 Moody ..... 441/2
5,551,901 A * 9/1996 Jaeger ..... 441/6
5,860,379 A * 1/1999 Moody ..... 114/54

* cited by examiner

*Primary Examiner*—Sherman Basinger
(74) *Attorney, Agent, or Firm*—Adams Intellectual Property Law, P.A.

(57) ABSTRACT

A sinkable buoy system including a guide buoy, an inflatable air bladder, a weight component, an air supply line and an air supply, wherein the air bladder and the weight component are not housed within a common housing. A system for inflating and deflating an air bladder in order to float a buoy at the surface and sink a buoy below the surface as desired. A sinkable buoy system for use with a water sports course in order to float buoys of the course during course use and sink the buoys when the course is not in use.

7 Claims, 7 Drawing Sheets

SINKABLE BUOY SYSTEM FOR USE WITH A WATER SPORTS COURSE

BACKGROUND OF THE INVENTION

1. Field of the Invention

The present invention relates generally to a system for readily sinking and floating one or more buoys, and more specifically, to a system for sinking and floating one or more buoys in a controlled manner and a sinkable buoy system for use with a modular water sports course.

2. Technical Background

Recreational and competitive water skiers and personal watercraft users typically practice and compete on water sports courses that include a plurality of buoys of varying diameters and colors that float on the surface and are arranged in a specific pattern to form a course. These buoys not only provide a path for a skier or personal watercraft to follow, but also typically include a path for a towboat to follow during a skiing pass. Skiers and personal watercraft users are typically judged on a run through the course based on time and their ability to successfully maneuver around the buoys. Most often, the buoys are configured in a slalom course, a trick course or a guide course that positions a boat and a skier for jumping. Courses may vary in buoy type, number and buoy position on the water.

There are currently several types of water sports courses in use, some of which include stationary courses, portable courses, controlled buoyancy courses and combinations thereof. Stationary courses typically include a permanent anchor or stake to maintain each individual buoy in a specific location. Buoys are typically attached to an anchor or stake using a tether made from a length of rope or cable that maintains the buoy at the proper height at the surface of the water. When an anchored buoy needs replacement, it is often necessary to access the anchor far below the surface of the water in order to attach a new tether. Stationary courses also include submerged cable systems, wherein buoys are attached to the cable system at multiple locations using ropes. Typical submerged cable systems include one or more cables that are linked together to form the length of the course and are held in place using large anchors placed about each end of the course. Cross-arms are typically attached laterally to the cable at various positions along the cable length. As tension is applied to the cable system as the anchors are pulled apart, the course is extended and proper distances between guide buoys are achieved. Cable systems are typically suspended about a meters below the surface of the water and are retrieved by entering the water or by grabbing the cable system with an anchor or hook to retrieve it.

Both individually anchored and submerged cable systems work quite well so long as the systems do not require repair and are able to remain in place without being disturbed during periods of inactivity. Since the buoys typically remain floating in both of these systems, they are exposed to damage from boats, swimmers, vandals, winter freezing and ultraviolet radiation that can cause the buoys to deteriorate over time. On crowded waterways, these particular courses may also become boating and swimming hazards. Further, a permanently installed stationary course may also become a point of contention among skiers, boaters and fishermen who all feel that they have a right to use that portion of the lake or river. As a result, many states and counties have enforced strict rules requiring individuals to remove buoys from the surface of the water when not in use or during certain hours. In this regard, skiers have attempted to overcome the disadvantages of stationary courses by removing the buoys after each use and allowing the remaining equipment to sink to the bottom. This results in extra time being spent in setting-up and tearing down a course between uses, specifically with regard to locating and accessing a submerged cable system, entering the water and attaching or removing the buoys.

Attempts have been made to overcome the disadvantages of stationary courses. In particular, portable courses have been developed that typically include collapsible or folding versions of submerged cable systems. Portable courses are typically carried in a user's boat to the ski site where the anchors, cable, cross-arms and buoys are assembled and launched into the water and tightened. Because of the need for a lighter course due to portability issues, these courses do not provide the durability or accuracy of the stationary anchored systems. Further, the greatest drawback to portable systems lies in the amount of time and labor required to install and retrieve them. Another drawback to these systems is the amount of space required to carry and store a portable system in a typical ski boat, and the space needed to store a portable course on land.

In an attempt to overcome the disadvantages described above, sinkable courses have been developed. In one particular example, U.S. Pat. No. 5,516,317 describes a system used to sink and float buoys. The system includes submarine devices comprising a cavity for holding both sand and an inflatable air bladder. Buoys are connected to the submarine devices using a length of rope. The weight of the sand inside a submarine device is enough to sink a buoy to the bottom of a lake or river when the air bladder is deflated. When the air bladder is inflated using air supplied via an air compressor or portable tank through a distributed network of tubing, enough buoyancy is created in the submarine to offset the weight of the sand, causing the buoys to float to the surface of the water. Thus, a course has been developed that is stationary in the sense that it does not have to be completely launched and retrieved from the water, but is moveable within the water by allowing the buoys to be floated and sunk as desired, thus reducing installation and set-up time and avoiding hazards and damage resulting from leaving buoys floating and unattended.

There are several disadvantages in the design of the system described in the U.S. Pat. No. 5,516,317 patent. First, the position of the submarine device in the system makes repair or replacement of an air bladder difficult due to the common housing and having to retrieve the heavy submarine from the water for repairs or maintenance. Further, the submarines in the '317 patent are positioned above the cable system to which they are attached, making it necessary to first retrieve the submarine from the water before the cable system itself can be retrieved. Another disadvantage of the current submarine design is the placement of the air bladder valve, which does not allow water that accidentally enters the bladder to drain. Further, maintenance of the air bladder portion results in the disturbance of the weight portion, and vice versa. Still further, maintaining the weight and the air bladder in a single submarine component requires that the internal cavity of the submarine remain accessible throughout the lifetime of the submarine, resulting in sealing issues and submarine material limitations that may be avoided by separating out the weight and air functions into separate components. Specifically, component expandability problems may be avoided using certain materials available as a result of separating air and weight components. Still further, general maintenance and repair of the U.S. Pat. No. 5,516,317 system is difficult and time consuming.

Accordingly, what is desired is an improved system to sink and float buoys that overcomes the disadvantages described above. What is further desired is a modular system including a guide buoys that may be raised to or lowered from the surface of the water using a distributed network of tubing to supply air from a single location using an air compressor or air pump. Still further, what is desired is a system for sinking and floating buoys that separates the weight component from the air bladder component in order to facilitate maintenance and repairs of the system and a cable to system to which it is attached. It would also be desirable to provide a water sports course that provides protection of the buoys from damage by other boaters and the environment, removes safety hazards associated with leaving buoys on crowded waterways, and allows skiers, boaters, and fisherman to use the same portion of a waterway for their own respective purposes.

SUMMARY OF THE INVENTION

In one aspect, the present invention is directed to a system for sinking and floating guide buoys. The system includes one or more buoys, an air bladder and a weight component, wherein the components are interconnected and removably attached using fastening devices and tethers of adjustable length. The air bladder and the weight component are separate components and are not housed within a common housing. The system further includes an air supply, such as an air compressor or air pump, operable for supplying/removing air to/from the air bladder via one or more flexible tubular components of a distributed tubular network. The weight component is preferably positioned at a lower depth than the air bladder, and more preferably at the lowest depth in the system or system to which it is attached. The buoy is preferably positioned closest to the surface of the water. In operation, air is supplied to the air bladder using the air supply to fill the air bladder with an amount of air sufficient to overcome the downward pull of the weight component, thus allowing the buoy to rise to the surface of the water and be visible. Air is removed from the air bladder using either the air supply or by releasing air through a valve, thus allowing air to escape from the air bladder and allowing the weight component to overcome the buoyancy of the air bladder and buoy, causing the buoy to sink below the surface of the water. The position of the buoy within the water is controlled by the amount of air present in the air bladder. All components are preferably interconnected using corrosion resistant hardware capable of being adjusted without the use of tools. All tether lengths may be adjusted based on water depth. The volume of air supplied to the air bladder is controlled by the air supply.

In another aspect, the present invention is directed to a plurality of individual systems used to sink and float buoys, wherein the systems are connected to a submerged cable system at predetermined locations in order to form a submergible water sports course, such as, but not limited to, a submergible water ski slalom course. The submerged cable system consists of linked sections of cable having various predetermined lengths and cable configurations. The cable system is preferably made up of a plurality of cable sections that may be attached together using readily removable clips in order to link sections to form a total cable system capable of individual segment replacement for costs savings. In alternative embodiments, the course may include a main cable having cross-arms positioned about perpendicular to the main cable at predetermined positions along the length of the main cable. In various embodiments, the cross-arms include predetermined lengths of rigid piping, such as, but not limited to, PVC piping. The individual sinkable systems are attached to the rigid piping at predetermined positions along the piping length to provide boat gates and guide buoys. The course is preferably extended and anchored at both ends using anchors. Cross-arms may be attached to the course using "V" shaped cables that attached to cable mounting plates. The cross-arms may also mount to the mounting plates. Cross-arm piping is preferably attached to each sinkable system at a position intermediate to the air bladder and the weight component, thus allowing the piping to be accessed from the surface of the water without retrieving the weight component from the water.

In yet another aspect, the water sports course includes a distributed network of air supply tubes operable for supplying/removing air to/from the plurality of air bladders in order to sink and the float the plurality of guide buoys as desired. In one embodiment, a main air supply tube is routed along and lashed to the cable sections, and a plurality of branch tubes are interconnected with the main air supply tube at the various cross-arm positions in order to supply air to the individual air bladders. Sections of air supply tubes are preferably interconnected using push-to-seal fittings as are known in the art. Air is preferably supplied to/removed from the air bladders using an air pump including an optional pressure gauge. An air pump is the preferred air supply based on the pressure needed to supply air throughout the distributed network. An air compressor may also function as the air supply. In various embodiments, the air supply tubes are preferably lashed to the cross-arm piping for protection from the environment and to avoid tangling. In alternative embodiment, the air supply tubing may be routed within portions of the cross-arms.

In a still further aspect, the present invention is directed to a measuring tool for verifying that guide buoys are inflated to the proper diameter required by buoy designations within a course. The tool includes a hollow cube-shaped housing having circular openings of varying predetermined diameters cut-out on designated sides of the housing. A deflated buoy is inserted into the cavity of the housing and inflated until the diameter of the buoy about equals the diameter of the corresponding hole. When the buoy is inflated to the appropriate diameter as verified by the corresponding hole, the buoy is then removed from the tool through its corresponding hole. In an official slalom course, for example, different sized buoys are typically used to designate skier and boat paths. The tool may be color-coded or otherwise labeled to correspond to buoy application.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description present exemplary embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the detailed description, serve to explain the principles and operations thereof. Additionally, the drawings and descriptions are meant to be illustrative and not limiting.

DETAILED DESCRIPTION OF THE PREFERRED EMBODIMENTS

Figure 1:
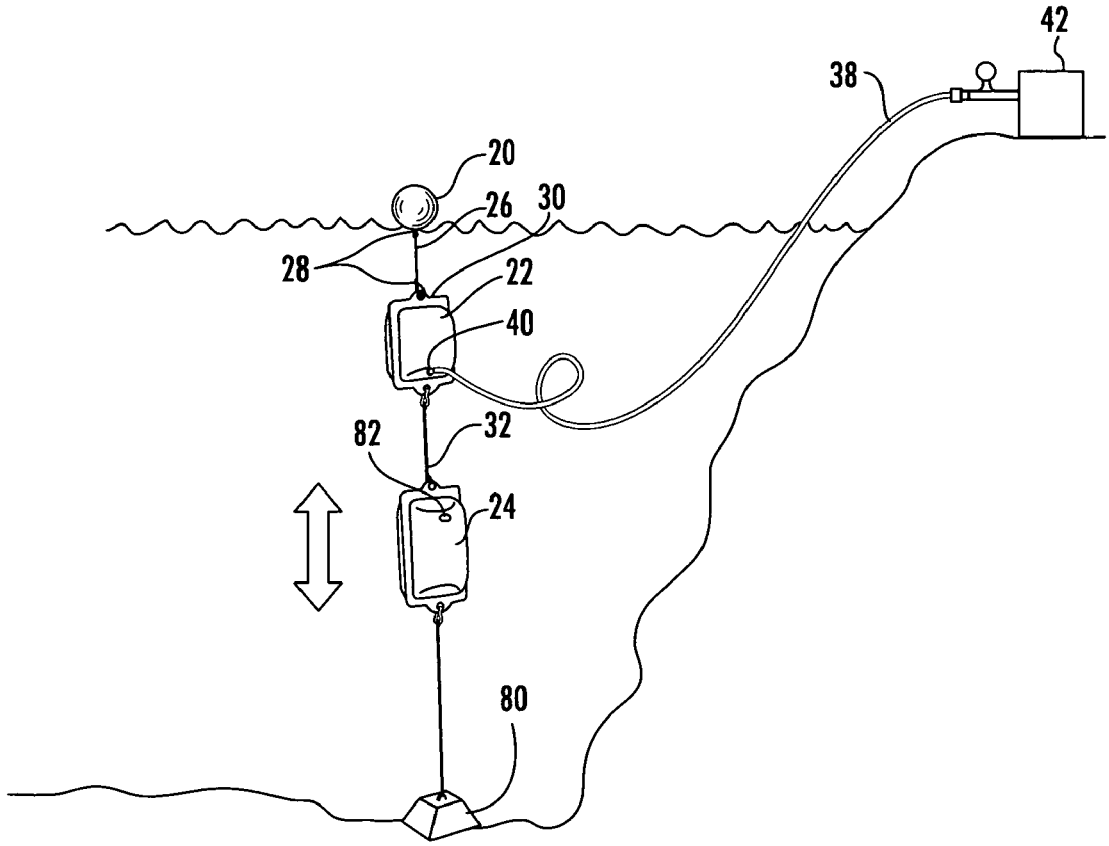
FIG. 1 is a schematic illustration of a system used to sink and float a buoy, wherein the buoy is shown floating at the surface.

Reference will now be made in detail to the present preferred embodiments of the invention, and examples of which are illustrated in the accompanying drawings. Whenever possible, the same reference numerals will be used throughout the drawings to refer to the same or like parts. While a slalom ski course is shown throughout the various figures as one potential application for the system to sink and float guide buoys of the present invention, it is envisioned that the system may be a stand-alone system or a component of other water sports courses, swim area designation systems or any other application in which it is desired to raise or lower a buoy to/from the surface of the water while achieving the advantages described in the present invention.

Referring now to FIG. 1, a system used to sink and float one or more buoys is shown. The system is shown attached to an anchor 80, for example, and anchor of a stationary water sports course. The system includes a buoy 20, an air bladder 22 and a weight component 24, among others, wherein the components are removably attached using fastening devices and tethers of adjustable lengths. The weight component 24 is positioned at a lower depth in the water than the air bladder 22, and is preferably positioned at the lowest depth in the system or when applied to a submerged cable system in order to facilitate maintenance and replacement of more shallow components by not having to retrieve the weight component 24 from the water. The air bladder 22 and the weight component 24 are not housed within a common housing, but are separate components to facilitate system maintenance. The buoy 20 is preferably positioned at the surface or at the most shallow depth in the system so that when the buoy is floating it is the only component at the surface of the water. The buoy 20 and the air bladder 22 are preferably removably attached using a tether 26 of adjustable length and any suitable fastener 28 commonly known in the art, such as a carabiner or like clip. Buoys are preferably made from high-quality PVC. The air bladder 22 and weight component 24 are preferably made from heat-sealed urethane coated nylon, but may also be made from PVC, nylon or other suitable material. The weight component 24 is filled with a predetermined amount of weight, for example sand, in order to provide a weight and a downward pull on the system. A plug 82 on the weight component 24 functions to allow weight to be added or removed from the weight component 24 as necessary.

The buoy 20, air bladder 22 and weight component 24 each include one or more eyelets 30 for receiving fasteners 28 or tethers. One end of the air bladder 22 is attached to the tether 26 of the buoy 20. The other end of the air bladder 22 may be attached to hardware for attaching a cross-arm and/or cable system of a water sports course to the system, or in the case of an independent system, the other end of the air bladder 22 is attached to a fastener 28 of another adjustable tether 32 of the weight component 24. Tethers 26, 32 are preferably made of a non-elastic rope (e.g., a braided polyester rope). Tether length is fully adjustable based on water depth. It may also be desirable to provide a greater tether length between the buoy 20 and the air bladder 22 as compared to the air bladder 22 and weight component 24 in order to position system components away from the surface of the water and protect a skier from tangling hazards.

As shown in FIG. 1, the air bladder 22 is connected to an air supply line 38, for example a polyethylene air tube, through a valve 40 positioned about the bottom end of the air bladder 22. The air supply line is connected to an air supply 42 located at a remote location. As shown, the air supply 42 is located on the shore. The air supply 42 may also be located aboard a boat or may be attached to another structure. Air supply packaging may include a housing, air pump, valves, pressure gauge, air-pressure relief valve, exhaust port, and quick connect tubing and fittings. The air supply 42 supplies/removes air to/from multiple air bladders through a distributed tubular network. The air supply 42 may be an air pump or an air compressor, but in preferred embodiments is an air pump operable for pumping air into and out of the system. The air supply may further include a control valve and an optional pressure gauge for measuring the amount of pressure present in the distributed network. In operation, air is supplied to the network to inflate the one or more air bladders 22 in order to overcome the downward pull of the weight component 24, thus making the buoy 20 rise to the surface of the water and be visible. To submerge the buoys 20, air is removed from the network using either an air pump or by opening a valve, thus allowing air to escape from the network and allowing the weight to overcome the buoyancy of the air bladders 22 and buoys 20. The depth of the buoys 20 within the water may be controlled by the amount of air present in the network. Air supply tubing is preferably interconnected using corrosion resistant fittings, such as, but not limited to push-to-seal, push-to-connect or other like fittings for connecting tubing.

Figure 2:
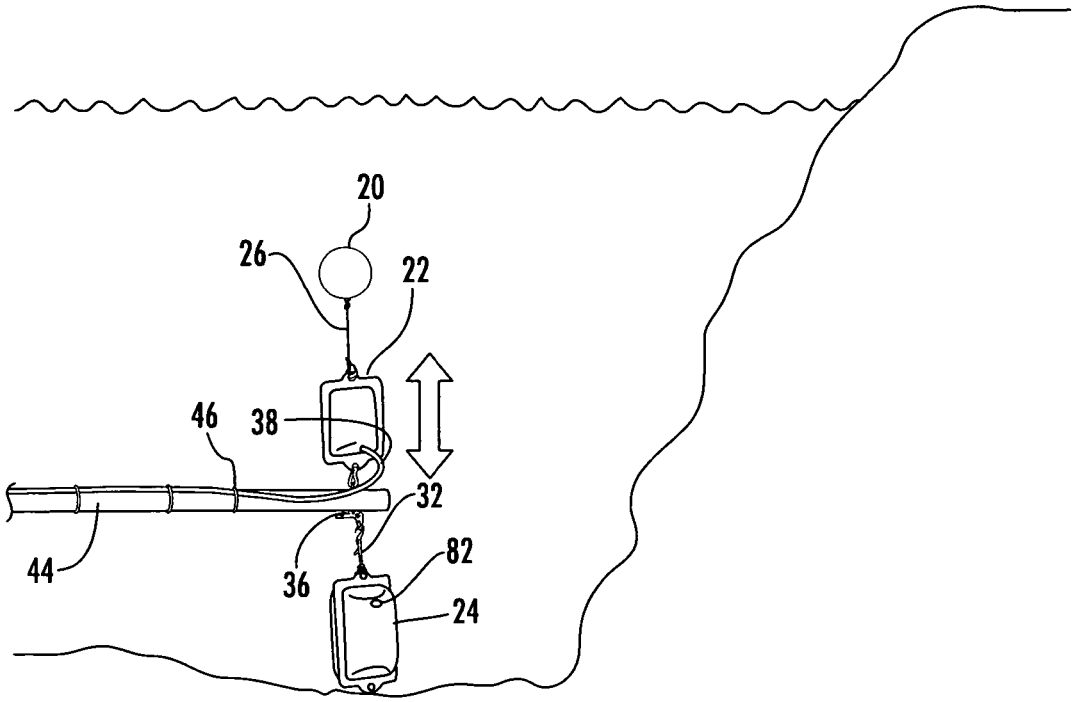
FIG. 2 is a schematic illustration of a system for sinking and floating a guide buoy shown attached to a portion of a cross-arm of a water sports course, and wherein the buoy is shown submerged.

Referring to FIG. 2, a system used to sink and float a buoy is shown attached to a portion of a cross-arm 44. The buoy 20 is shown in a submerged position. The air supply line 38 is routed along the cross-arm 44 and interconnects with the distributed air supply network. The air supply tubing 38 may be lashed or otherwise fastened to the cross-arm 44 using cable-ties 46, zip-ties or other like fasteners. In an alternative embodiment (not shown), the air supply line 38 may be routed within a portion of the hollow cross-arms in order to protect the air supply line 38 from the environment. The system may be lowered until the weight component 24 contacts the river or lake bottom, or may be lowered to a predetermined depth.

Figure 3:
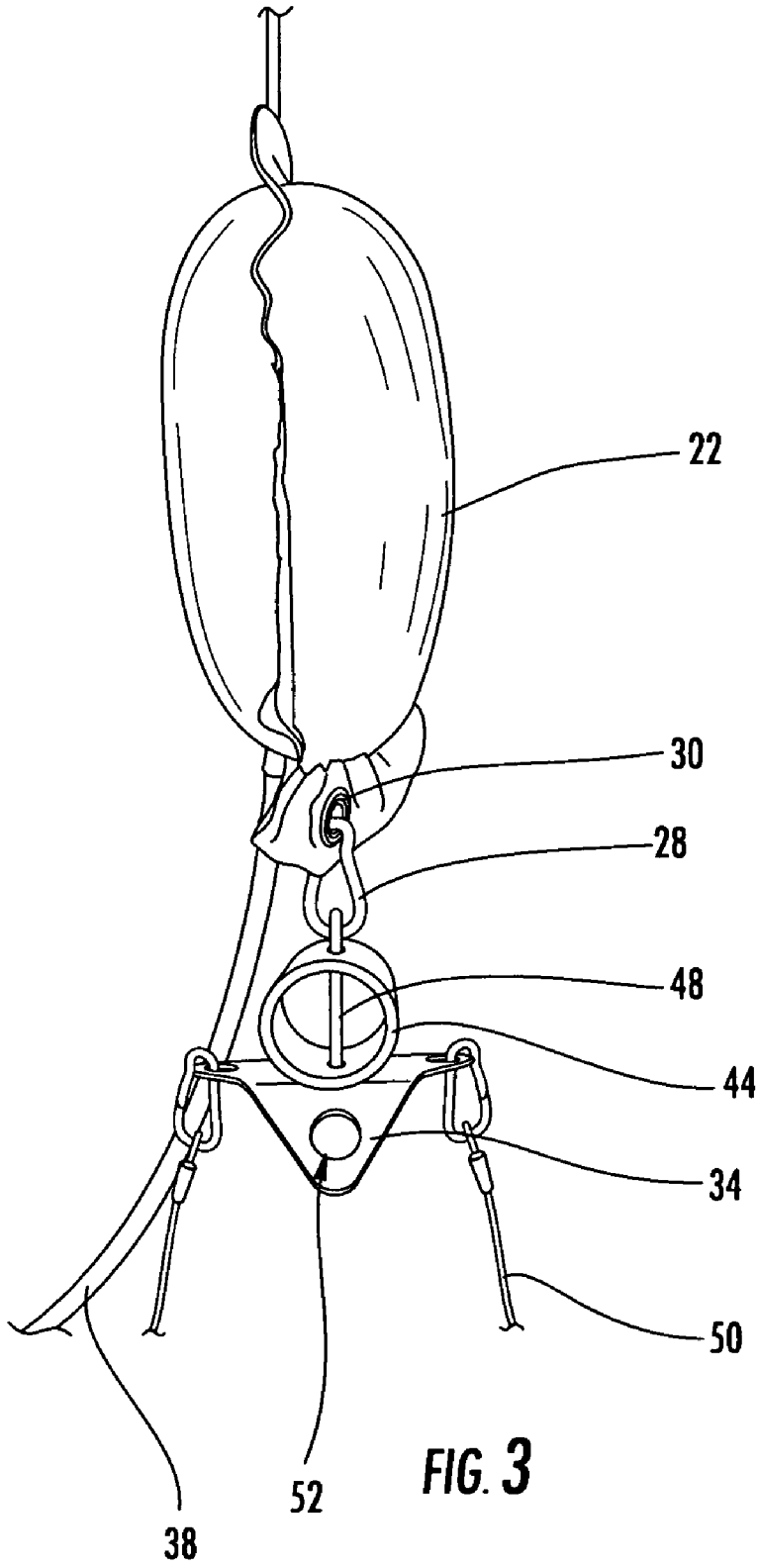
FIG. 3 is an enlarged view of a portion of the system shown in FIG. 2.
Figure 4:
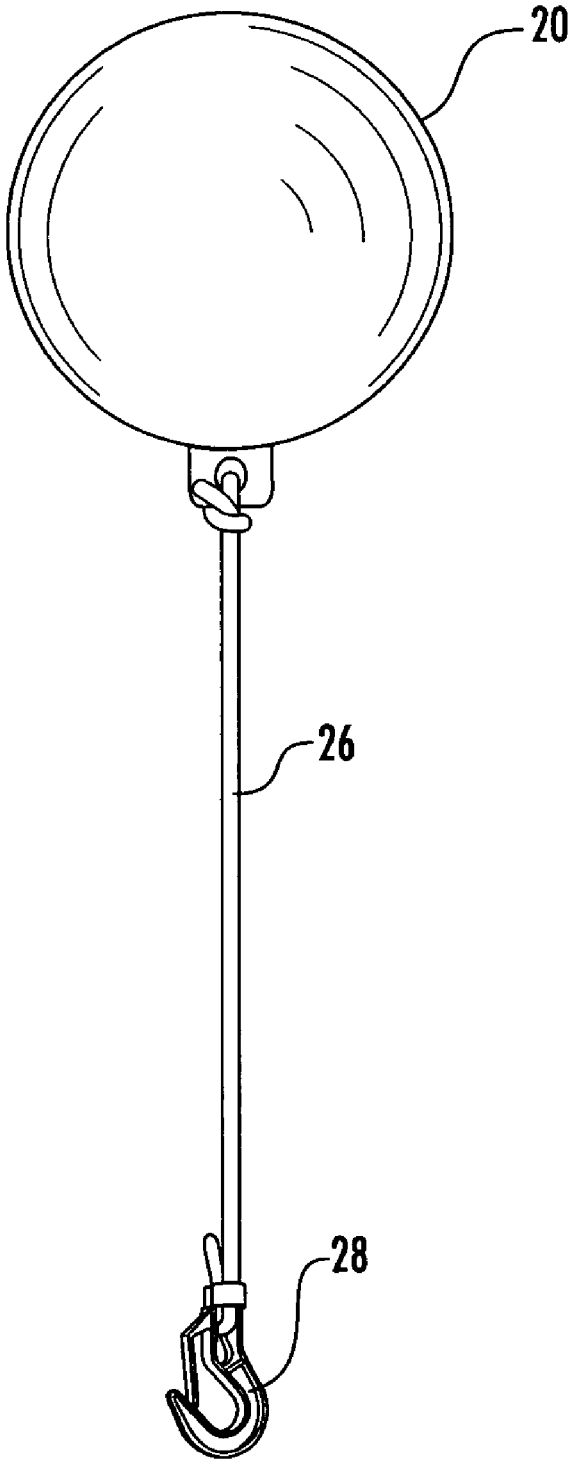
FIG. 4 is a perspective view of a fastening device for attaching a guide buoy using an adjustable length tether.

Referring to FIG. 3, an enlarged view of a portion of the system is shown with the weight component detached. The air bladder 22 is attached to an eye bolt 48 using a releasable clip 28. The eye bolt 48 is in turn routed through the section of PVC cross-arm 44 and is secured to the cable mounting plate 34 by a nut (not shown). The cable mounting plate 34 defines one or more holes for receiving cables 50 used to connect a cross-arm 44 to the main cable of a water sports course. Hole 52 is used to attached the tether interconnected with the weight component. Cables preferably pull from opposing sides of the cross-arm to maintain the cross-arm position. The cable mounting plate 36 is preferably made from a corrosion resistant metal for strength and surability. Referring to FIG. 4, one example of a fastener 28 for attaching the tether 26 of the buoy 20 is shown. The fastener 28 is a readily releasable plastic clip that allows for the adjustment of the length of a tether. This exemplary clip or others that provide a similar function may be used throughout the system to interconnect components. Clips are preferably acetyl clips and are used based on their low absorption rate.

Figure 5:
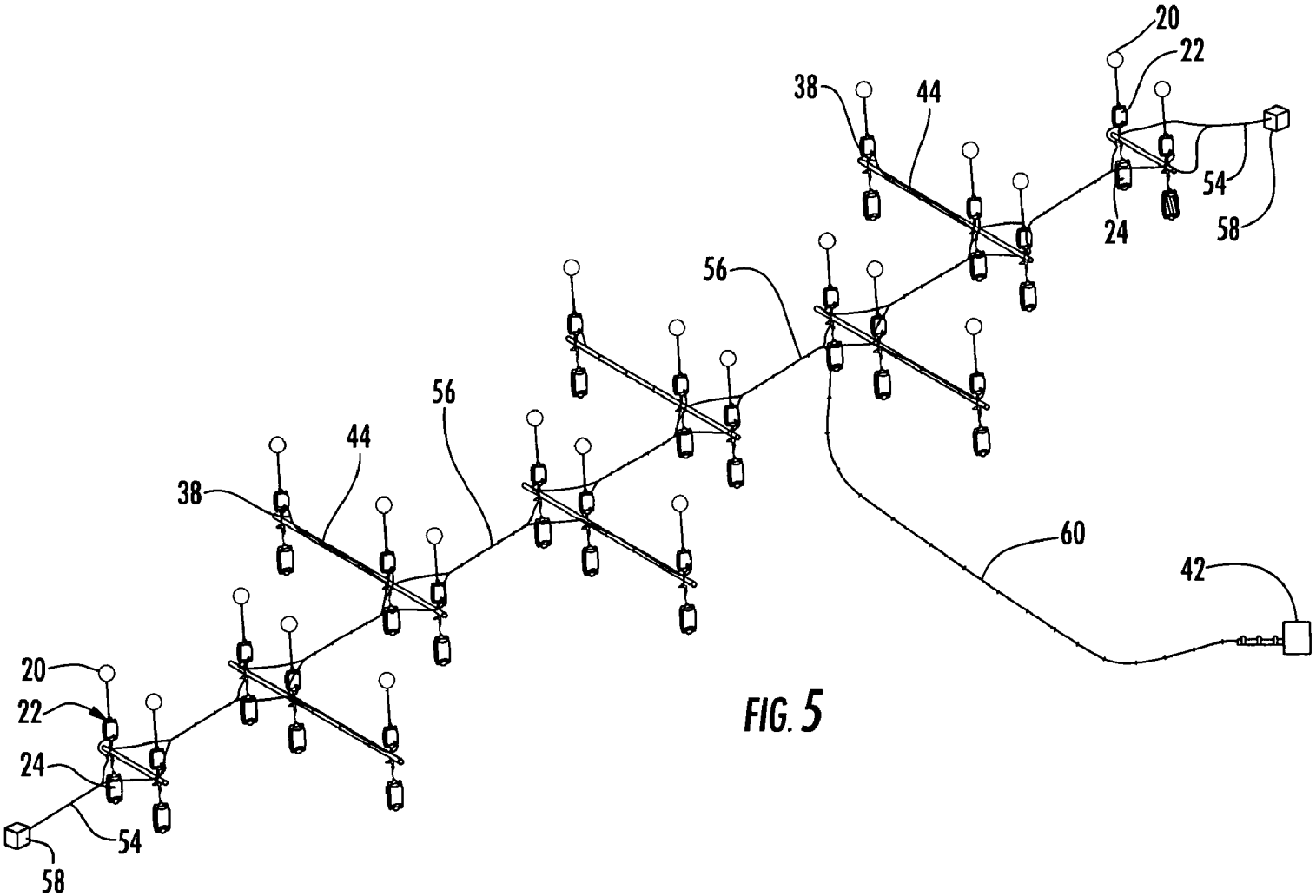
FIG. 5 is a schematic diagram illustrating a plurality of sinkable buoy systems applied to a submerged cable system to provide a sinkable water sports course.
Figure 6:
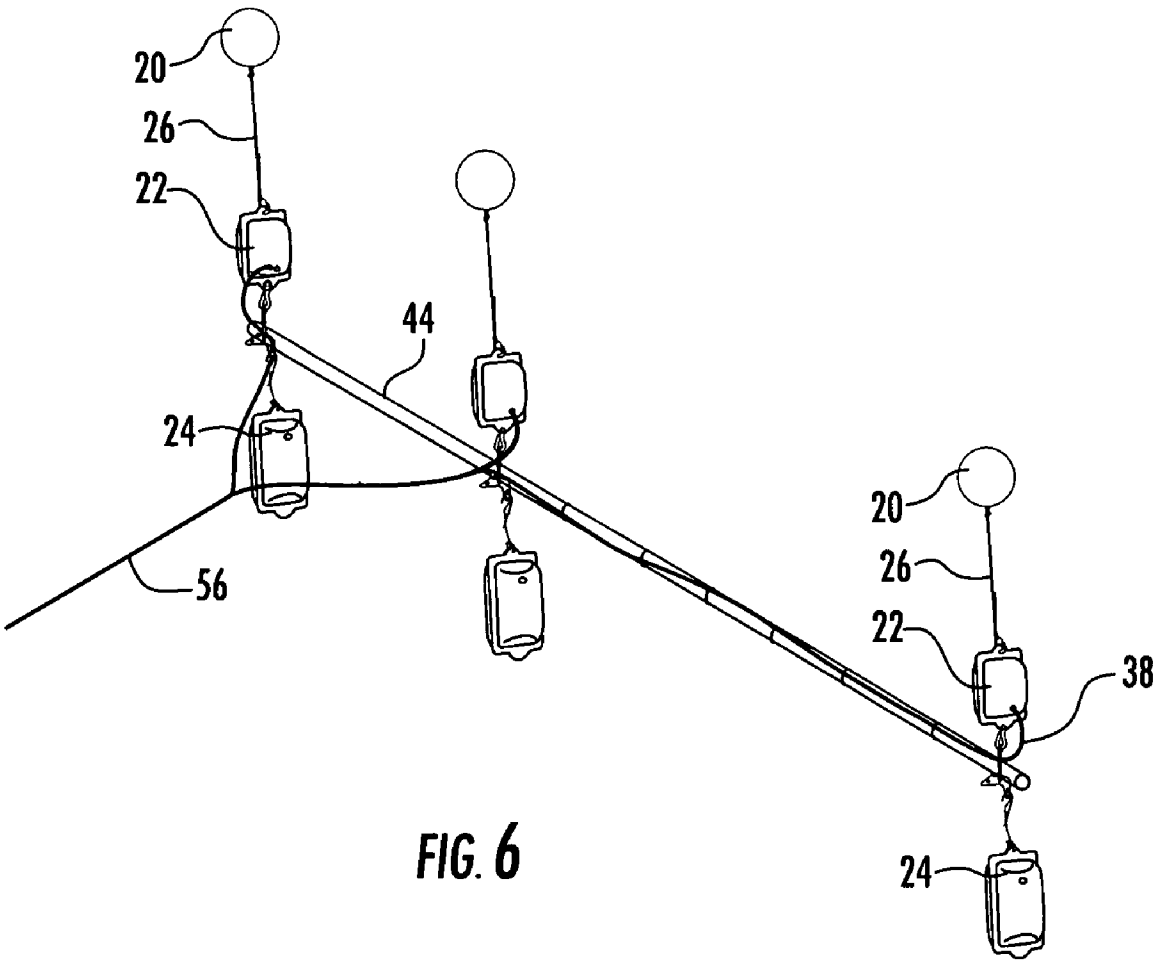
FIG. 6 is an enlarged schematic diagram illustrating a portion of the course shown in FIG. 5.

Referring to FIG. 5, multiple systems to sink and float buoys may be applied to a typical water sports cable system to allow the guide buoys to be submerged or floated as desired. The exemplary course shown is an official slalom ski course and is just one of many course configurations that may be used for skiing, boating, swimming, etc. The course shown is symmetrical and can be entered from either end. FIG. 6 illustrates a middle section of the course in more detail. The course includes a plurality of steel cable sections (or ropes) that are connected together to form a submerged cable system. The cable system includes end sections 54 and middle sections 56 that are fastened together. The cable system is modular and individual sections may be removed and replaced without having to replace the entire cable system, thus saving costs. "V" shaped sections may be linked together using straight sections, and all sections are removably attached. Cable sections may be color-coded to indicate their position within the course. In one example, cable sections may be red-green and yellow to correspond with buoy course buoy colors. The entire system is held in place using anchors 58 attached about each end of the system. The anchors 58 are preferably attached to the system using a cable, chain or rope, for example, a three-strand nylon rope (braided). The elasticity of a rope provides tension on the cable system and maintains the proper distance between sets of guide buoys. The anchors may be concrete, steel or containers for holding sand or any other suitable weight.

Systems used to sink and float buoys are attached at multiple positions along the cross-arms 44. As stated above, the weight component 24 is attached below the cross-arm 44, the air bladder is attached above the cross-arm 44, and the buoys 20 are attached above the air bladder 22. An air supply line 38 is connected to each air bladder 22 in the system to provide a distributed air supply network. The air supply lines 38 are lashed to the cross-arms 44 and cable segments 56 at specified intervals. An air supply line leading to the air supply 42 is shown at reference number 60.

Figure 7:
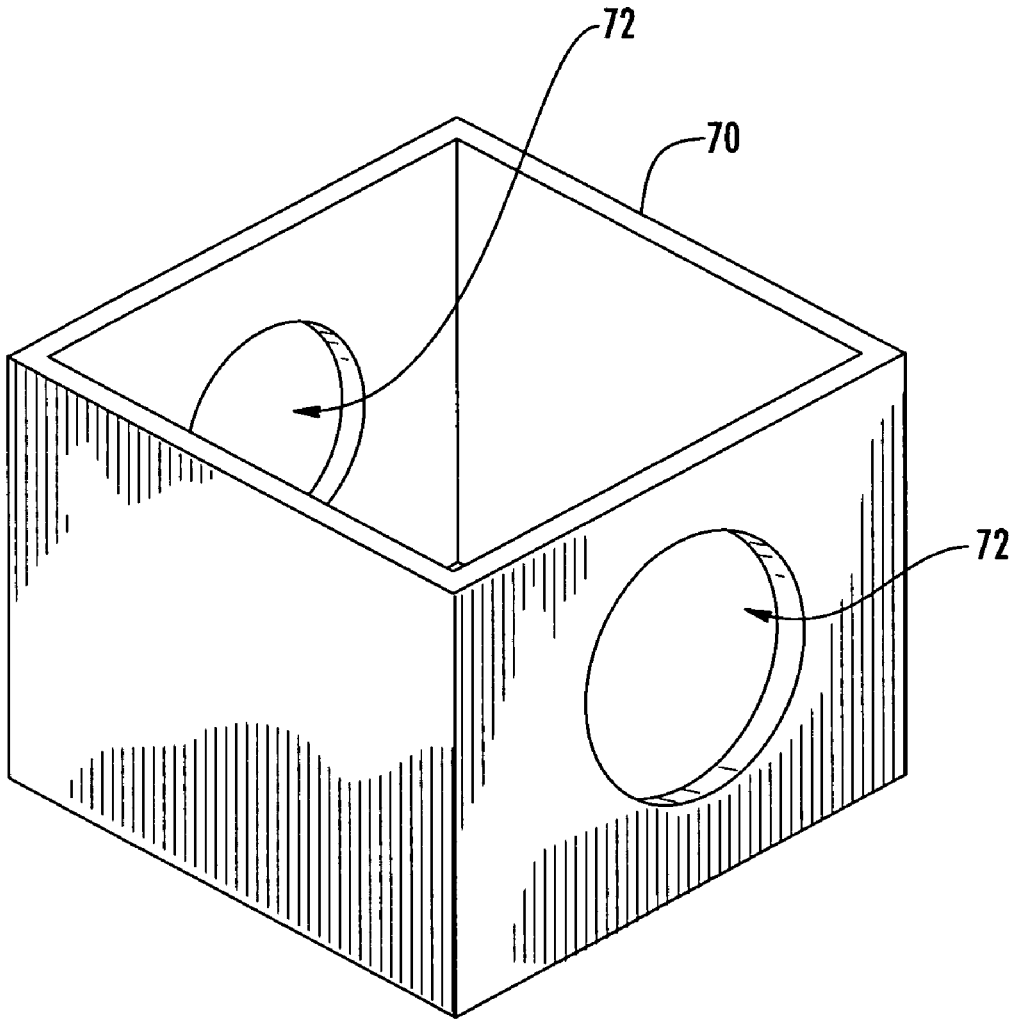
FIG. 7 is a perspective view of a tool for verifying proper buoy inflation.

Referring to FIG. 7, a tool for measuring and verifying the diameter of an inflated buoy is provided. The tool includes a hollow cube-shaped housing 70 having circular openings 72 of varying predetermined diameters cut-out on designated sides of the housing 70. The tool may be collapsible and compact. A deflated buoy is inserted into the cavity of the housing 70 and inflated until the diameter of the buoy equals the diameter of its corresponding hole. When the buoy is inflated to the appropriate diameter and compared to the corresponding hole size, the buoy is removed from the tool through the matching hole. In an exemplary slalom course example, buoys of varying diameters and colors are used to designate paths for the skier and boater to follow. The tool may be color-coded or otherwise labeled to indicate which colored buoy corresponds to which hole size. For example, red buoys are typically used to designate the starting gate and the gates for the skier to follow, and are typically inflated to about 7 to about 11 inches, more preferably about 7.8 inches in diameter. Yellow buoys are typically used to mark the path for the boat to follow, and are typically about 8 to about 11 inches in diameter, preferably about 9 inches in diameter. Green buoys may be used to mark boat path alignment gates and are typically about 8 to about 11 inches in diameter, preferably about 9 inches indiameter. The buoys may be inflated using the air supply also used for inflating the air bladders.

In operation, when submerged, the buoy should remain at the most shallow depth as compared to the rest of the system, but should be submerged to a depth sufficient to prevent boaters and swimmers from accidentally coming in contact with any component of the system or the cable system to which it is attached. Submerging the system further protects it from ice and ultraviolet radiation that can cause color fading. To raise the buoys, air is simply introduced into the distributed network at the air supply until all of the buoys have risen to the surface. In slalom ski courses, for example, it is desirable for only about one-half of the guide buoys to be visible on the surface. A pressure relief valve may be present to protect the system and limit the amount of pressure within the system. As the air bladders inflate, enough buoyancy is created to offset the weight of the weight component and any attached cable system and allow the buoys to rise to the surface. Inflation time may vary based on the type of air supply used.

An advantage to the system described in the present invention includes the ability to readily repair components positioned above the weight component without having to retrieve the weight component from the water. Another advantage is the ability to protect the system and other boaters and swimmers when the course is not in use by submerging the system. In an alternative embodiment, a plurality of guide buoys may be attached directly to a cable system or other structure of a water sports course. One or more individual flotation systems including an air bladder component and a weight component are attached to the cable system or other course structure in order to raise or lower the course, thus floating or submerging the guide buoys.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. A sinkable buoy system, comprising:

a heat-sealed urethane coated nylon air bladder including a valve positioned about a bottom end of the air bladder;

a buoy removably connected to the air bladder by a tether having an adjustable length, wherein the buoy floats above the air bladder in the water;

a weight removably connected to the air bladder by a tether having an adjustable length, wherein the weight is positioned below the air bladder in the water;

an air supply coupled to the air bladder through an air supply line and operable for selectively supplying and removing a volume of air to and from the air bladder;

a mounting plate for mounting the buoy system to a cross-arm of a water sports course, the mounting plate defining attachment points for attaching at least one cross-arm position maintaining cable for connecting the cross-arm to a main cable of the water sports course, the mounting plate positioned between the air bladder and the weight;

wherein the buoy system is operable for floating and submerging the buoy to a predetermined depth and in a controlled manner.

2. The sinkable buoy system according to claim 1, wherein a plurality of the sinkable buoy systems are interconnected by a distributed air supply network.

3. A water sports course, comprising:

a plurality of cross-arms linked together by one or more cable sections;

an anchor attached to and positioned about each end of the course operable for maintaining the course in an extended position;

a plurality of buoy systems, each buoy system comprising an air bladder including a valve positioned about a bottom end of the air bladder, a buoy tethered to the air bladder, a tethered weight, and a mounting plate for mounting the buoy system to one of the plurality of cross-arms, the mounting plate defining attachment points for attaching the cable sections thereto for maintaining the plurality of cross-arms in position;

a network of air supply lines for interconnecting the air bladders, wherein the air supply lines are lashed to the plurality of cross-arms and the one or more cable sections; and an air supply connected to the network of air supply lines operable for supplying and removing air to and from the air bladders.

4. The water sports course according to claim 3, wherein the air bladder is a heat-sealed urethane-coated nylon bag.

5. The water sports course according to claim 3, wherein the course is a water ski slalom course.

6. A sinkable buoy system, comprising:

an air bladder including a valve positioned at the bottom of the air bladder for attaching an air line;

a buoy tethered to the air bladder;

a weight tethered to the air bladder;

a mounting plate for mounting the buoy system to a cross-arm of a water sports course, the mounting plate defining attachment points for attaching at least one cross-arm position maintaining cable for connecting the cross-arm to a main cable of the water sports course, the mounting plate positioned between the air bladder and the weight; and an air supply coupled to the air line for supplying and removing air from the system;

wherein the buoy is positioned above the air bladder in the water and the weight is positioned below the air bladder in the water.

7. The sinkable buoy system according to claim 6, wherein the air bladder is a heat-sealed urethane coated nylon bag.

* * * * *